US006126090A

United States Patent [19]

Wadsworth et al.

[11] Patent Number: 6,126,090

[45] Date of Patent: Oct. 3, 2000

[54] NOZZLE CAP FOR TRIGGER SPRAYER

[75] Inventors: Ronald Wadsworth, Cambria, Calif.; William L. Driskell; Joseph K. Dodd, both of Lee's Summit, Mo.

[73] Assignee: Calmar Inc., City of Industry, Calif.

[21] Appl. No.: 09/228,647

[22] Filed: Jan. 12, 1999

[51] Int. Cl.[7] ..... B05B 9/043; A62C 11/00

[52] U.S. Cl. ..... 239/333; 239/436; 239/437; 239/451; D9/450; 222/380; 222/383.1

[58] Field of Search ..... 239/333, 436, 239/437, 451; 222/153.14, 380, 383.1; D9/448, 449, 450, 451

[56] References Cited

U.S. PATENT DOCUMENTS

| | | | |
|---|---|---|---|
| D. 268,204 | 3/1983 | Wesner et al. . | |
| D. 320,162 | 9/1991 | Sorenson | D9/448 |
| D. 409,487 | 5/1999 | Wadsworth et al. | D9/448 |
| D. 409,918 | 5/1999 | Wadsworth et al. | D9/448 |
| 3,703,994 | 11/1972 | Nigro | 222/402.17 X |
| 3,711,030 | 1/1973 | Jones | 222/402.17 X |
| 3,891,128 | 6/1975 | Smrt | 222/402.17 |
| 4,020,982 | 5/1977 | Micallef . | |
| 4,204,614 | 5/1980 | Reeve | 222/383.1 X |
| 4,234,128 | 11/1980 | Quinn et al. . | |
| 4,516,695 | 5/1985 | Garneau | 222/380 X |
| 4,706,888 | 11/1987 | Dobbs . | |
| 5,114,052 | 5/1992 | Tiramani et al. | 222/380 X |
| 5,228,600 | 7/1993 | Steijns et al. | 222/380 X |
| 5,687,880 | 11/1997 | Maas et al. . | |
| 5,878,959 | 3/1999 | Smolen, Jr. et al. | 239/333 X |

*Primary Examiner*—Andres Kashnikow
*Assistant Examiner*—Robin O. Evans
*Attorney, Agent, or Firm*—Dykema Gossett PLLC

[57] ABSTRACT

A trigger actuated pump sprayer has a nozzle cap rotatable on the sprayer nozzle into one of four on and off positions. The cap is of a rectangular section having opposing pairs of flat walls which are grasped by the operator to facilitate cap rotation.

Ridges or flutes are provided along the adjoining edges of the walls to avoid slippage of the hand from the nozzle during rotation in either direction about its central axis. The nozzle is positively set in each of its on and off positions by a snap detent/cavity engagement between the pump body and the cap, or a protuberance/notch engagement between the cap and the pump body.

18 Claims, 3 Drawing Sheets

NOZZLE CAP FOR TRIGGER SPRAYER

BACKGROUND OF THE INVENTION

This invention relates generally to a trigger operated pump sprayer having a nozzle cap which can be more positively and safely operated without slippage, and which is capable of being more accurately set between rotative on and off positions to avoid leakage.

The present invention comprises an improvement over U.S. Pat. No. 4,706,888, commonly owned herewith, and directed to a nozzle assembly having a four-sided nozzle cap of rectangular cross-section, opposing pairs of flat walls respectively associated with off and on rotative positions of the cap. Rotation in either direction about the central axis of the cap controls the nozzle between off and on positions.

As the cap is a relatively small part the operator oftentimes has difficulty in manipulating cap rotation, especially when that operator is a person whose physical adroitness may be weak, or whose hands may be wet or damp or who may simply have a weak grip.

The user's fingers thus tend to slip off the nozzle cap upon rotation in either direction. If the cap is not fully rotated to one of its on positions, passages and grooves acting between the coaxial core and the cap skirt telescoped about that core remain mismatched such that the nozzle remains closed. As the user then further rotates the cap to assure positioning in the intended on position, the trigger may have already been actuated such that the user's hand or some other body portion of the user becomes a spray target, which is totally undesirable. Otherwise any residual liquid in the discharge passage which may have accumulated in the process of the earlier partial cap rotation, could leak on to the hand of the user when the cap is again more fully rotated to its on position.

Likewise during the process of rotating the nozzle cap between on and off positions, should the cap not be completely rotated to one of its off positions, the passages and grooves acting between the coaxial core and the telescoping skirt of the nozzle cap further remain mismatched even if ever so slightly. Thus should the spray package be tilted to its side or should the trigger be nudged or inadvertently squeezed, the slight spray which may discharge from the nozzle, is undesirable. Moreover with the nozzle in less than a completely off position residual liquid in the discharge passage of the pump body could easily leak out through the orifice.

SUMMARY OF THE INVENTION

It is therefore an object of the present invention to provide a nozzle cap for a trigger sprayer which operates similarly as described in the U.S. Pat. No. 4,706,888 patent which avoids the aforestated drawbacks in a simple and economical yet highly effective manner.

The nozzle cap according to the invention has radially extending ridges or flutes integrally formed along the four edges of the rectangular cap to thereby minimize the tendency for slippage of the users fingers from the nozzle cap upon rotation between its on and off positions. The ridges provide stops in both directions against which the user's fingers bear upon cap rotation to thereby improve upon the grip of the cap for both operators with diminished finger dexterity and for users with wet, damp or greasy fingers. Cap rotation to its appropriate on or off positions is more accurately assured with the nozzle of the invention thereby avoiding leakage of liquid product from the discharge orifice.

Further in accordance with the invention the nozzle cap and confronting portion of the pump body have cooperating means for accurately and positively setting the cap in each of its on and off positions upon cap rotation. For this purpose a snap detent may be provided on the pump body and four detent receiving cavities may be provided on a confronting wall of the nozzle cap for accurately setting the cap in one of its on or off positions. Cooperation between the detent and the selected cavity provides an audible signal to the operator of the correct setting of the cap. Otherwise, small protuberances at each of the four on and off positions of the cap may be provided for cooperation with one or more depressions provided on the nozzle of the trigger sprayer pump body giving the operator a tactile signal on the correct setting of the cap.

Other objects, advantages and novel features of the invention will become more apparent from the following detailed description of the invention when taken in conjunction with the accompanying drawings.

DETAILED DESCRIPTION OF THE INVENTION

Figure 1:
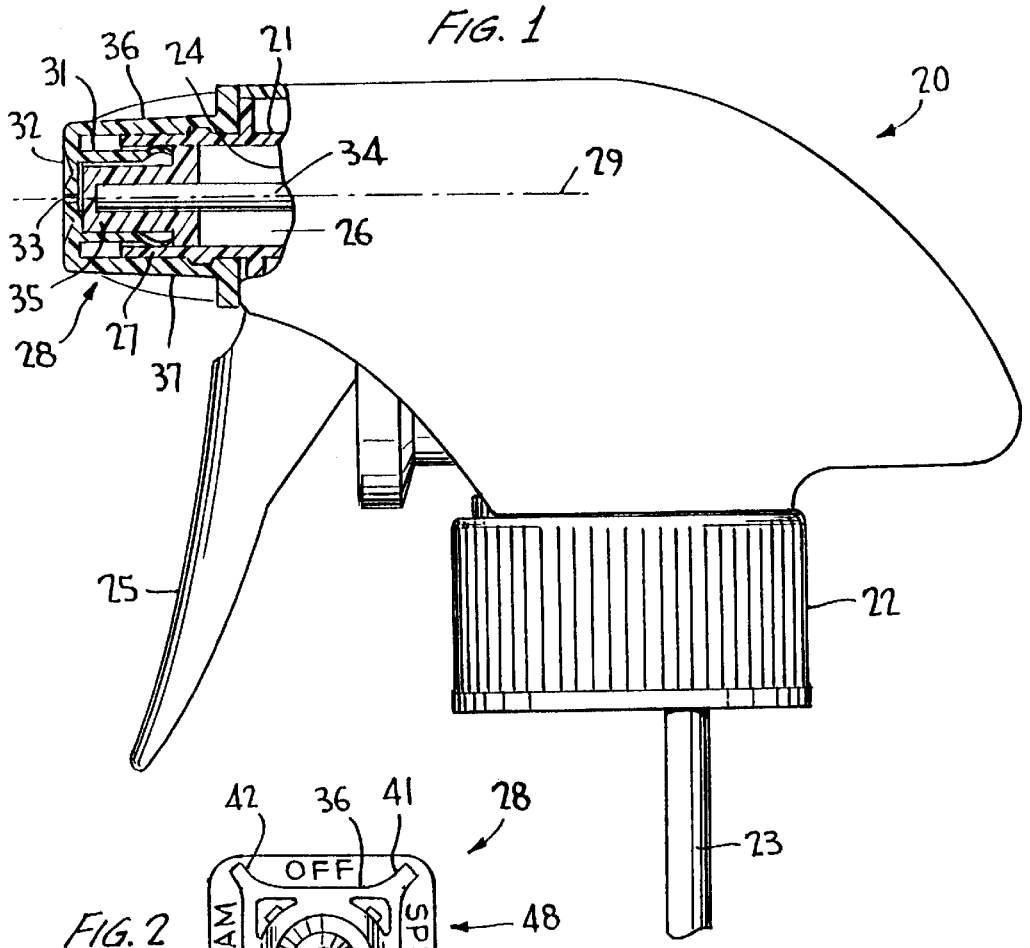
FIG. 1 is a side elevational view, partly in section, of a trigger actuated pump sprayer incorporating the invention.
Figure 2:
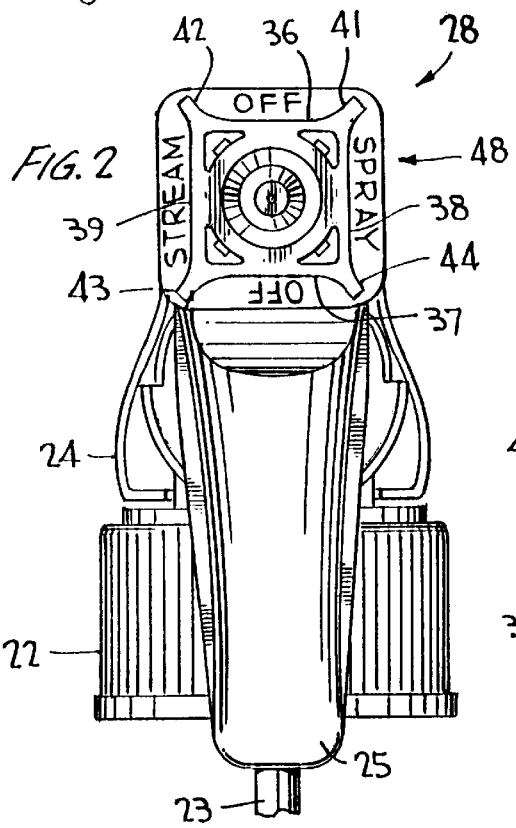
FIG. 2 is an elevational front view of the trigger sprayer of FIG. 1.

Turning now to the drawings wherein like reference characters refer to like and corresponding parts throughout the several views, a trigger actuated pump sprayer is generally designated 20 in FIG. 1 as comprising a pump body 21 to which a container closure 22 is coupled for mounting the sprayer to a container (not shown) of liquid to be sprayed. A dip tube 23 is suspended from the pump body and extends into the container, and the pump body may be covered by a separate or integral shroud 24. A trigger lever 25 is pivotally mounted to the pump body for actuating the pump piston (not shown) reciprocating in the pump cylinder (not shown) upon trigger actuation as known in this art.

The pump body has a discharge barrel defining a passage 26 which terminates in a discharge nozzle 27.

A nozzle cap 28 is mounted on the end of the nozzle by a snap fit effected between a rib on the nozzle and an internal groove on the cap, as shown. The cap is thereby rotatable about its central axis 29 without shifting along that axis.

As shown in FIG. 1 the cap has an internal sleeve 31 extending inwardly along axis 29 from an end wall 32 which contains a discharge orifice 33 on axis 29. The pump body has a fixed coaxial core 34, and a plug 35 is mounted on the free end of the core and is assembled to the pump body in some normal manner as to resist rotation about axis 29 upon cap rotation. The plug has longitudinally extending grooves terminating in radial/tangential channels which open into a spin chamber, the channels and spin chamber being located either at the terminal end of plug 35 or being formed in the confronting end wall 32 of the nozzle cap. The inner wall of sleeve 31 which telescopes about plug 35 has a plurality of passages which, upon rotation of the cap match with the longitudinal passages in predetermined on positions of the nozzle. A mismatch between the grooves and the passages upon cap rotation effects an off position of the nozzle.

The details of the spray nozzle operation upon cap rotation are specifically disclosed in the aforementioned U.S. Pat. No. 4,706,888 patent and are not repeated here. The entirety of the disclosure of that U.S. Pat. No. 4,706,888 patent is therefore specifically incorporated herein by reference.

As more clearly shown in FIGS. 2 to 8, nozzle cap 28 is of rectangular cross-section formed of four flat walls such as a first pair of opposing walls 36, 37, and a second pair of opposing walls 38, 39. The flat walls may be parallel to central axis 29, or may slope downwardly toward that axis in a forward direction, as shown.

Figure 3:
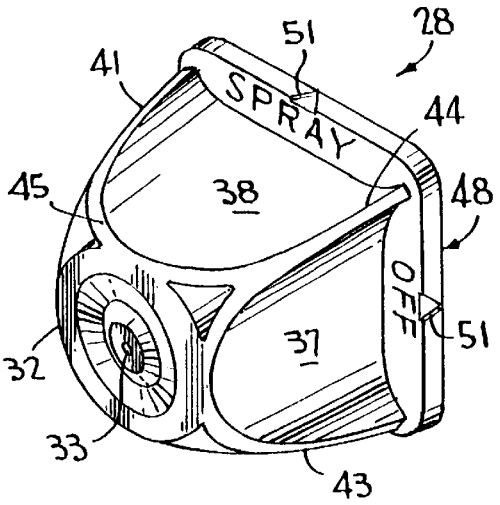
FIG. 3 is a perspective front view of the nozzle cap of FIG. 1, at an enlarged scale, showing details of the invention.

In accordance with the present invention, a plurality of ridges or flutes 41, 42, 43, 44 are provided along the adjoining edges of the walls forming the nozzle cap. The ridges each extend radially outwardly and continuously from a rearward end of the cap toward the forward end of the cap but terminate slightly from end wall 32, as shown in FIG. 3. Each of the ridges slope downwardly toward the central axis of the cap from the rearward to the forward ends thereof. A typical ridge is clearly shown in FIG. 8 as terminating a short distance from end wall 32. And the forward ends of the flat walls are curved as typically shown at 45 for wall 38 in FIG. 3 so as to blend in smoothly with the upper edges of the associated ridges 41, 44, the ridges blending smoothly with their respective flat walls as at 46, 47 (FIG. 4) such that the opposing pairs of outer walls of the nozzle cap each are contoured to the user's fingers which grasp those walls in pairs as to facilitate cap rotation.

The nozzle cap may likewise have a peripheral flange 48 (FIGS. 2, 3, 4) forming a rearward wall of the nozzle cap (FIG. 6), the flange lying perpendicular to the central axis 29 of the cap. The flange is essentially rectangular in plan view with rounded corners and forms a back wall for each of the ridges from which the ridges extend. Moreover, the nozzle cap is of a one-piece molded plastic construction.

Figure 4:
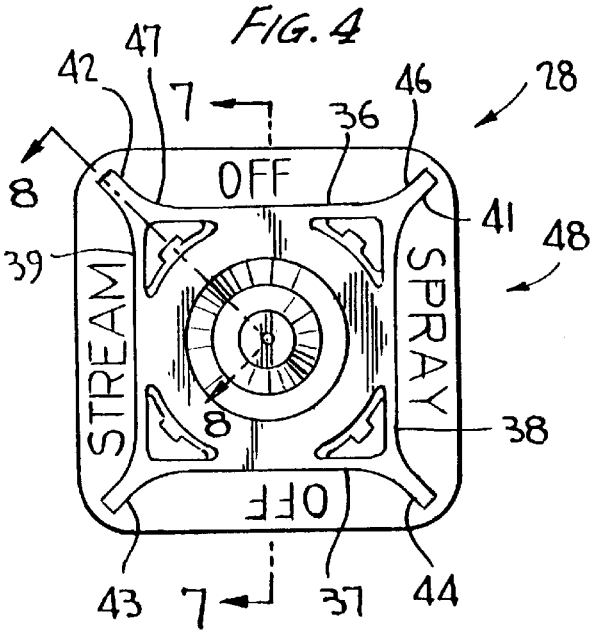
FIG. 4 is a front elevational view of the nozzle cap of FIG. 3.
Figure 9:
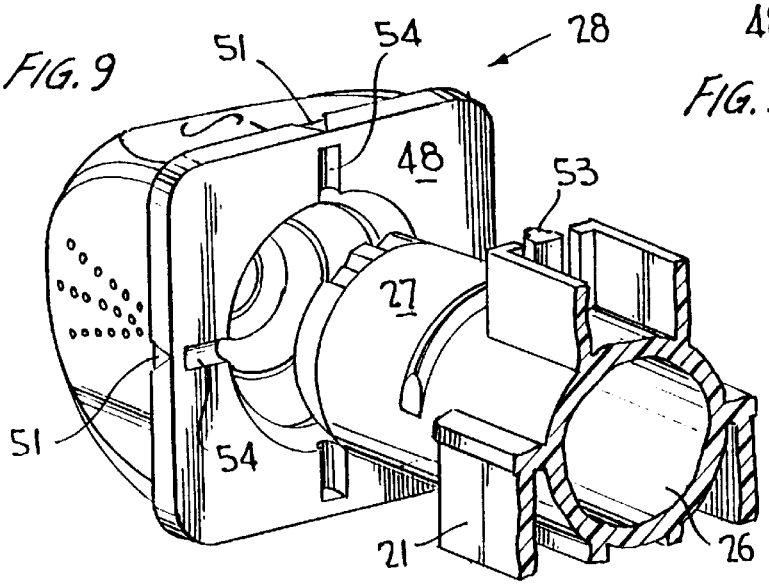
FIG. 9 is a rear perspective view of another embodiment of the nozzle cap of the invention and an adjoining portion of the pump body, in expanded view.
Figure 10:
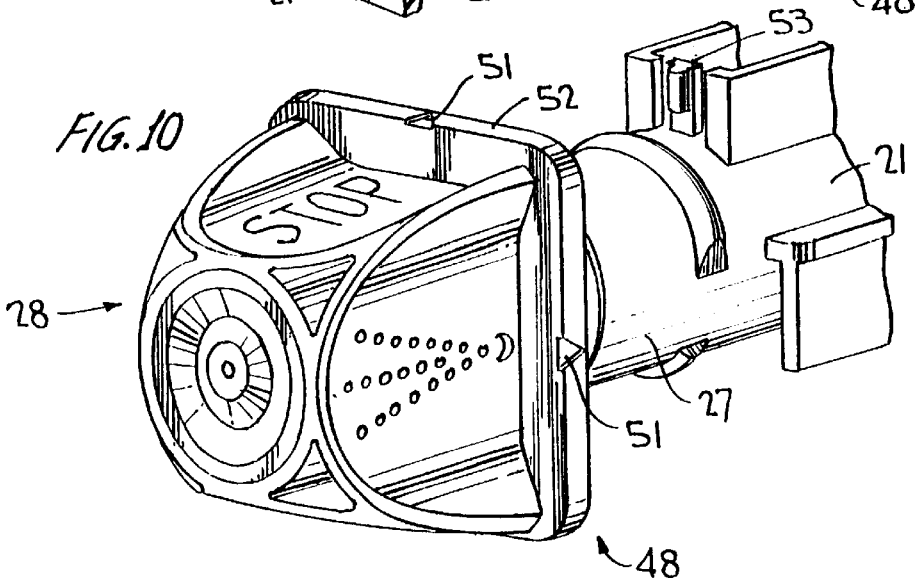
FIG. 10 is a front perspective view of the nozzle cap and adjoining pump body portion of FIG. 9, in expanded view.

Indicia may be provided on the front face of the peripheral flange, such as OFF, SPRAY, STREAM, or ON (not shown), as shown in FIG. 4, associated with the two off modes and the two on modes of the nozzle assembly. Otherwise indicia such as STOP (FIG. 5) may be provided on the outer surfaces of walls 36, 37, and indicia such as a spray pattern symbol (FIGS. 9, 10) may be provided on the outer surfaces of walls 38, 39, for respectively indicating the two on and the two off modes of the nozzle assembly.

Figure 5:
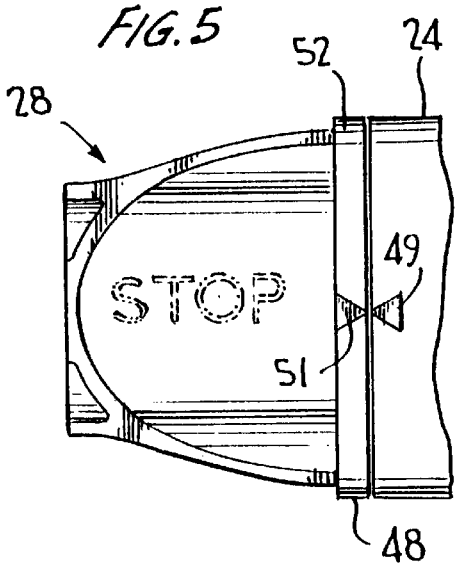
FIG. 5 is a top plan view of the nozzle cap and a portion of the adjoining pump body of FIG. 1.
Figure 6:
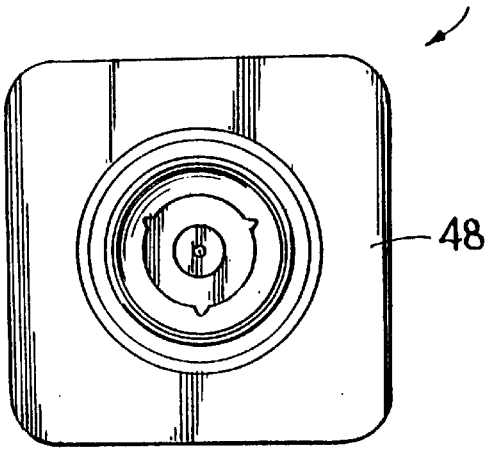
FIG. 6 is a rear elevational view of the nozzle cap of FIG. 3.
Figure 7:
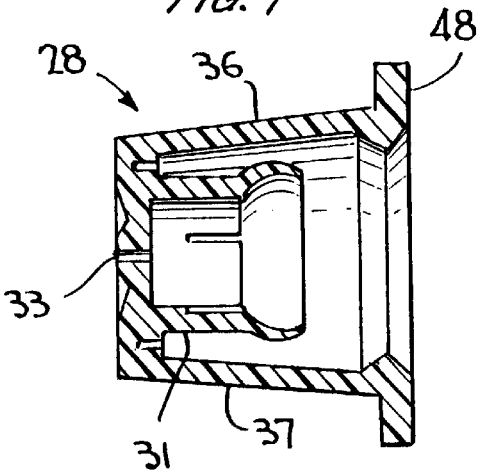
FIGS. 7 and 8 are cross-sectional views taken substantially along lines 7—7 and 8—8 of FIG. 4.
Figure 8:
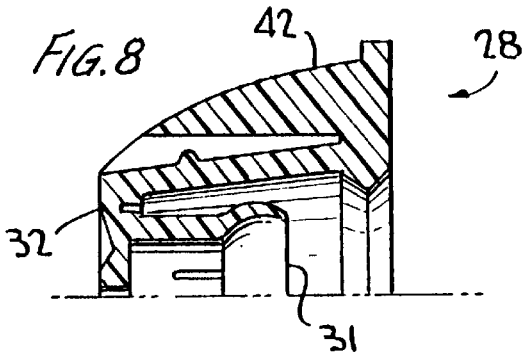

Also indicia such as a small triangle 49 (FIG. 5), with mirror image small triangles 51 on the centerline of each outer edge 52 of peripheral wall 48 may be provided for readily indicating to the operator a particular off or on position of the nozzle cap upon rotation. When the points of the triangles (or other similar indicia) coincide, as shown in FIG. 5, the operator is assured that the nozzle is turned completely off, or completely on as when the nozzle is rotated to one of its on positions.

In operation, the operator grasps a first opposing pair of flat side walls 36, 37 or 38, 39 of the nozzle cap, in any normal manner as with the thumb and forefinger, from the front of the sprayer to adjust the nozzle setting. The opposing side walls are substantially contoured to the thumb and forefinger by reason of the specific structure of cap 28 as aforedescribed.

The operator thus applies a rotative force in either direction whereupon the thumb and forefinger tend to shift in that rotative direction until limited by one of the pairs 41, 44 or 44, 43 or 43, 42 or 42, 41 of the ridges formed integrally as part of the nozzle cap. The operator's hand is thus less likely to slip when turning the nozzle cap, and less finger pressure against the opposing walls of the cap is required. The cap is therefore rotatable with less effort, more quickly and securely and with less regard to the condition or strength of the user's hands.

Also, the peripheral flange 48 serves to limit the extent of any slippage of the operator's fingers along axis 29 during cap rotation. The flange further serves as an indicia carrier as aforedescribed.

As shown in FIGS. 9 to 12, means for accurately setting the nozzle cap in each of its four rotative on and off positions is shown as provided in one embodiment by a spring-biased snap detent 53 located on the top side of nozzle 27 of the pump body in alignment with triangular indicia 49. On the back side of peripheral wall of flange 48 there are provided four detent receiving cavities 54 respectively in alignment with triangular indicia 51 located on the center lines of outer edges 52 of flange 48. Thus each cavity 54 is associated with one of the flat walls of the nozzle cap which is in turn associated with one of the four on and off positions.

Figure 11:
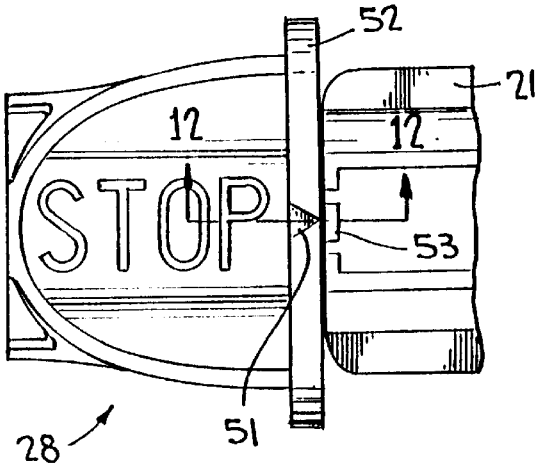
FIG. 11 is a top plan view of the FIG. 9 nozzle cap shown assembled to the adjoining pump body portion.
Figure 12:
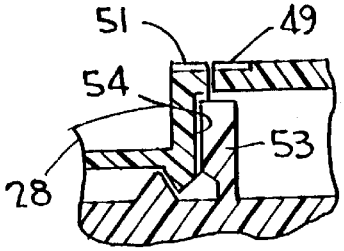
FIG. 12 is a sectional view taken substantially along the line 12—12 of FIG. 11.

Referring to FIGS. 11 and 12, the nozzle cap is shown accurately set in one of its off or stop positions as spring biased detent 53 engages with cavity 54 associated with that stop or off position. Indices 51, 49 are aligned in such position to inform to the operator that the nozzle is in a completely off position thereby avoiding any leakage of product from orifice 33.

The nozzle cap is shifted to one of its on positions upon rotation of the cap about axis 29 through 90° in either direction. In the process of cap rotation, cavity 54 is moved in along a circumferential path away from detent 53 such that the dent simply slides against the smooth surface of the back of flange 48 until one of the two on positions is reached. At that position detent 53 extends into its confronting cavity 54. As the detent shifts from its abutment against smooth wall of flange 48 to its extension into the confronting cavity 54, a "snap" is audible to the operator by reason of the sharp outer edges of the cavity. The "snap" or the "click" heard by the operator confirms that the nozzle cap is set in its intended on position and will not stray from that position until positively rotated by the operator.

Figure 13:
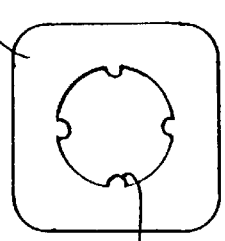
FIG. 13 is a rear elevational view of another embodiment of a nozzle cap according to the invention.
Figure 14:
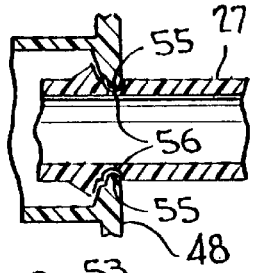
FIG. 14 is a sectional view similar to FIG. 12 of the FIG. 13 cap accurately set on the discharge nozzle of the pump body.

In lieu of a snap detent 53/cavity 54 engagement of FIGS. 9 to 12, a tactile setting arrangement can be provided such that the operator simply senses by feel that the nozzle cap is in one of its four set positions upon rotation. As shown in FIGS. 13 and 14, the cap is provided with small inwardly extending bosses or protuberances 55 respectively associated with triangles 51 on flange 48. An opposing pair of the protuberances as shown (or at least one) extend into small mating notches or depressions 56 formed in the outer surface of nozzle 27. Thus upon cap rotation from one of the off positions to one of the on positions, a tactile impression is made as the operator senses the engagement between bosses 55 and notches 56 as the cap reaches one of its four intended set positions.

From the foregoing it can be seen that the trigger sprayer has a nozzle cap which can be more easily operated without slippage and which is accurately and quickly set in one of its four on/off positions by an audio or tactile impression. When positively set in one of the two off positions, there is less tendency for leakage of product from the orifice.

Obviously, many modifications and variations of the present invention are made possible in the light of the above teachings. It is therefore to be understood that within the scope of the appended claims the invention may be practiced otherwise than as specifically described.

What is claimed is:

1. A trigger actuated pump sprayer comprising, a pump body and closure means coupled thereto for attaching the sprayer to a container of liquid to be dispensed, the body having a discharge passage terminating in a nozzle at a forward end of the sprayer, a nozzle cap mounted on said nozzle for rotation without axial movement between on and off positions about a central axis of said cap coaxial with said passage, the cap having a discharge orifice on said central axis, and the cap having a first pair of opposing flat walls and a second pair of opposing flat walls, said first and second pairs of walls being joined along opposing edges of the walls to define four corners of a rectangular body extending in a direction along said central axis, the improvement wherein at least one ridge integral with said cap is provided along one of said corners extending from a rearward end toward a forward end of said cap and extending radially outwardly relative to said central axis, said at least one ridge decreasing in height from said rearward end toward said forward end, and said at least one ridge defining anti-slippage means on said nozzle cap during rotation in one direction or another about said central axis by an operator grasping said first pair of opposing walls or said second pair of opposing walls as said at least one ridge provides a limit stop against which the operator's fingers bear upon rotation in said one or said another direction.

2. The trigger actuated pump sprayer according to claim 1, wherein said one ridge is provided along each of said corners, each said ridge providing limit stops against which the operator's fingers bear upon rotation in said one or said other direction.

3. The trigger actuated pump sprayer according to claim 1, wherein said nozzle cap further has a peripheral rectangular flange extending radially outwardly of said walls at the rearward end of said cap integral with said ridge, said flange defining limit stops in an axial direction of said cap when grasping said first or said second pair of walls.

4. The trigger actuated pump sprayer according to claim 2, wherein said nozzle cap has a peripheral rectangular flange extending radially outwardly of said walls at the rearward end of said cap integral with each said ridge, said flange defining limit stops in an axial direction of said cap when grasping said first or said second pair of walls.

5. The trigger actuated pump sprayer according to claim 3, wherein indicia is provided on front portions of said flange at each of said walls to identify the spray position of the cap upon rotation.

6. The trigger actuated pump sprayer according to claim 4, wherein indicia is provided on front portions of said flange at each of said walls to identify the spray position of the cap upon rotation.

7. A manually actuated trigger sprayer having a pump body and a closure cap coupled thereto for mounting the sprayer to the neck of a container of liquid product to be dispensed, the pump body having a liquid discharge barrel terminating in a discharge nozzle, a nozzle cap mounted on said nozzle for rotation about the central axis thereof without axial displacement between on and off positions, the nozzle cap being of rectangular cross-section having four flat side walls, the improvement wherein cooperating means are provided on said body and said cap for accurately and positively setting said cap in said on and off positions upon the rotation of the cap, and wherein at least one ridge integral with said cap is located along one of four corners of adjoining pairs of said four walls, said at least one ridge extending from a rearward end to a forward end of said cap and extending radially outwardly relative to a central axis of said cap, said at least one ridge decreasing in height from said rearward end toward said forward end, and said at least one ridge defining anti-slippage means on said nozzle cap to provide a limit stop against which an operator's fingers bear upon rotation of said cap between said on and off positions.

8. The manually actuated trigger sprayer according to claim 7, wherein said nozzle cap further has a peripheral flange at said rearward end thereof extending radially outwardly of said flat walls for providing stops in an axial direction for the fingers of the operator when grasping said flat walls.

9. The trigger actuated pump sprayer according to claim 7, wherein said cooperating means are provided on a rear face of said cap and on said discharge barrel.

10. The trigger actuated pump sprayer according to 8, wherein detent means are provided on said body and four cavities are provided on a back wall of said flange associated with said on and off positions selectively receiving said detent for accurately setting said nozzle cap upon cap rotation.

11. The trigger actuated pump sprayer according to claim 10, wherein said detent means are spring-biased.

12. The manually actuated trigger sprayer according to claim 7, wherein said cooperating means comprise a snap detent on one of said body and said cap and detent receiving cavities on the other of said body and said cap, said cavities being associated with each of said on and off positions for providing an audible signal when the cap is accurately set in one of its rotative positions.

13. The manually actuated trigger sprayer according to claim 7, wherein said cooperating means comprise shallow cavities associated with each of said on and off positions and a shallow detent extending into one of said cavities for providing a tactile indication of the accurate setting of the cap in its selected rotative position.

14. A trigger actuated pump sprayer comprising, a pump body and closure means coupled thereto for attaching the sprayer to a container of liquid to be dispensed, the body having a discharge passage terminating in a nozzle at a forward end of the sprayer, a nozzle cap mounted on said nozzle for rotation without axial movement between on and off positions about a central axis of said cap coaxial with said passage, the cap having a discharge orifice on said central axis, and the cap having a first pair of opposing flat walls and a second pair of opposing flat walls, said first and second pairs of walls being joined along opposing edges of the walls to define four corners of a rectangular body extending in a direction along said central axis, the improvement wherein at least one ridge integral with said cap is provided along one of said corners extending from a rearward end toward a forward end of said cap and extending radially outwardly relative to said central axis, said at least one ridge decreasing in height from said rearward end toward said forward end, said at least one ridge defining anti-slippage means on said nozzle cap during rotation in one direction or another about said central axis by an operator grasping said first pair of opposing walls or said second pair of opposing walls as said at least one ridge provides a limit stop against which the operator's fingers bear upon rotation in said one or said another direction, and indicia provided on an outer wall of said pump body and matching indicia provided on said cap at each of said walls to assist in accurately identifying the condition of the sprayer upon cap rotation.

15. The trigger actuated pump sprayer according to claim 14, wherein said setting means comprise a spring-biased detent on one of said pump body and said nozzle cap and four cavities associated with said four positions on the other of said pump body and said nozzle cap for selectively receiving said detent upon cap rotation.

16. A trigger actuated pump sprayer comprising, a pump body and closure means coupled thereto for attaching the sprayer to a container of liquid to be dispensed, the body having a discharge passage terminating in a nozzle at a forward end of the sprayer, a nozzle cap mounted on said nozzle for rotation without axial movement between on and off positions about a central axis of said cap coaxial with said passage, the cap having a discharge orifice on said central axis, and the cap having a first pair of opposing flat walls and a second pair of opposing flat walls, said first and second pairs of walls being joined along opposing edges of the walls to define four comers of a rectangular body extending in a direction along said central axis, the improvement wherein at least one ridge integral with said cap is provided along one of said corners extending from a rearward end toward a forward end of said cap and extending radially outwardly relative to said central axis, said at least one ridge decreasing in height from said rearward end toward said forward end, said at least one ridge defining anti-slippage means on said nozzle cap during rotation in one direction or another about said central axis by an operator grasping said first pair of opposing walls or said second pair of opposing walls as said at least one ridge provides a limit stop against which the operator's fingers bear upon rotation in said one or said another direction, and means acting between confronting portions of said nozzle cap and said pump body for accurately setting said cap in each of four predetermined rotative positions.

17. The trigger actuated pump sprayer according to claim 16, wherein said setting means comprise a spring-biased snap detent and four snap recesses associated with said four positions on one of said pump body and said nozzle cap for providing an audible signal when the cap is accurately set in one of its four rotative positions.

18. The trigger actuated pump sprayer according to claim 16, wherein said setting means comprise four detent receiving cavities associated with said four positions and a cooperating detent for providing a tactile indication of the accurate setting of the cap in one of its four rotative positions.

* * * * *